US011993996B2

(12) United States Patent
Saleh et al.

(10) Patent No.: US 11,993,996 B2
(45) Date of Patent: May 28, 2024

(54) TUBING-CASING ANNULUS SCANNER TOOL

(71) Applicant: SAUDI ARABIAN OIL COMPANY, Dhahran (SA)

(72) Inventors: Ahmed Ali Saleh, Dammam (SA); Anas Mahmoud Albalawi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 56 days.

(21) Appl. No.: 17/811,432

(22) Filed: Jul. 8, 2022

(65) Prior Publication Data

US 2024/0011364 A1 Jan. 11, 2024

(51) Int. Cl.
*E21B 33/072* (2006.01)
*E21B 47/002* (2012.01)
*E21B 47/08* (2012.01)

(52) U.S. Cl.
CPC ..... *E21B 33/072* (2013.01); *E21B 47/0025* (2020.05); *E21B 47/08* (2013.01)

(58) Field of Classification Search
CPC .... E21B 33/072; E21B 47/0025; E21B 47/01; E21B 47/08; E21B 23/001
See application file for complete search history.

(56) References Cited

U.S. PATENT DOCUMENTS 2,102,080 A * 12/1937 Kinley ..... E21B 47/08 33/544.2
2,340,987 A * 2/1944 Robidoux ..... E21B 47/08 324/355
5,355,952 A 10/1994 Meynier
8,169,337 B2 * 5/2012 Evans ..... G01V 11/002 166/250.01
8,459,348 B2 * 6/2013 Mineo ..... E21B 29/04 166/241.5
2010/0193186 A1 8/2010 Smith

OTHER PUBLICATIONS

Garcia, Javier, et al., "Successful Application of a New Electromagnetic Corrosion Tool for Well Integrity Evaluation in Old Wells Completed with Reduced Diameter Tubular," IPTC 16997, International Petroleum Technology Conference, Mar. 2013, pp. 1-12 (12 pages).

* cited by examiner

*Primary Examiner* — D. Andrews
(74) *Attorney, Agent, or Firm* — Osha Bergman Watanabe & Burton LLP

(57) ABSTRACT

A system includes a first tubular body deployed within a second tubular body, a scanner tool, and an electronically conductive cable. The scanner tool is movably disposed around the outer circumferential surface of the first tubular body and located within an annulus. The scanner tool includes a tool housing, a conduit, and calipers. The tool housing has a housing outer surface and a housing inner surface. The conduit is defined by the housing inner surface. The first tubular body extends therein. The calipers are distributed around the housing outer surface. The calipers are configured to measure well data. The electronically conductive cable is connected to the tool housing and is configured to transmit the well data between the scanner tool and a computer located at a surface location. The electronically conductive cable is further configured to move the scanner tool up hole and downhole along the first tubular body.

17 Claims, 5 Drawing Sheets

TUBING-CASING ANNULUS SCANNER TOOL

BACKGROUND

In the oil and gas industry, hydrocarbons are located in porous formations far beneath the Earth's surface. Wells are drilled into the formations to produce the hydrocarbons. Wells are made out of wellbores drilled into the Earth's surface supported by one or more strings of casing that are cemented in place. Often, a production string is run into the inner most casing string to provide a conduit for the hydrocarbons to migrate to the surface. The production string may include tubulars connected together and may be interspersed with various pieces of equipment such as artificial lift equipment, packers, etc. The space formed between the production string and the inner most casing string is called the tubing-casing annulus. Once the production string has been installed, there is no way to access the tubing-casing annulus without de-completing the well and removing the production string from the well.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for scanning an annulus. The systems of one or more embodiments include a first tubular body deployed within a second tubular body, a scanner tool, and an electronically conductive cable. The first tubular body forms an annulus between an outer circumferential surface of the first tubular body and an inner circumferential surface of the second tubular body. The scanner tool is movably disposed around the outer circumferential surface of the first tubular body and located within the annulus. The scanner tool includes a tool housing, a conduit, and a plurality of calipers. The tool housing has a housing outer surface and a housing inner surface. The conduit is defined by the housing inner surface. The first tubular body extends therein. The plurality of calipers are distributed around the housing outer surface. The plurality of calipers are configured to measure well data. The electronically conductive cable is connected to the tool housing and is configured to transmit the well data between the scanner tool and a computer located at a surface location. The electronically conductive cable is further configured to move the scanner tool up hole and downhole along the first tubular body.

The methods of one or more embodiments include installing a first tubular body within the second tubular body to form an annulus between an outer circumferential surface of the first tubular body and an inner circumferential surface of the second tubular body and installing a scanner tool into the annulus. The scanner tool is movably located around the first tubular body such that the first tubular body extends through the scanner tool. The method further includes connecting an electronically conductive cable to a tool housing of the scanner tool, running the scanner tool up hole and downhole along the first tubular body within the annulus using the electronically conductive cable, scanning the well using a plurality of calipers on the scanner tool to obtain well data, and transmitting the well data to a computer located at a surface location using the electronically conductive cable.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
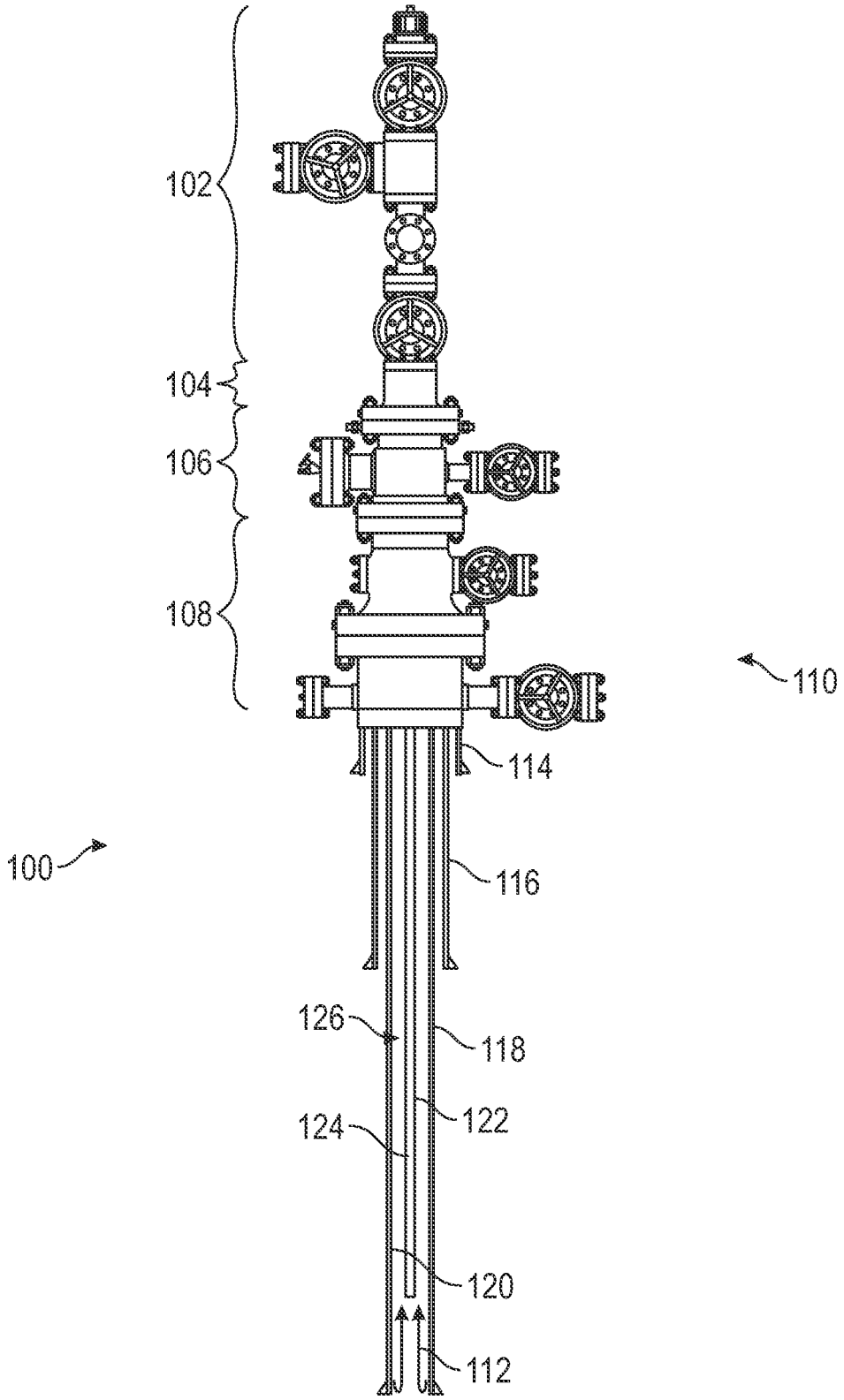
FIG. 1 shows an exemplary well in accordance with one or more embodiments.

FIG. 1 shows an exemplary well (100) in accordance with one or more embodiments. The well (100) includes a tree (102), a tubing bonnet (104), a tubing head (106), and a casing head (108) located on a surface location (110) that may be located anywhere on the Earth's surface. The tree (102) has a plurality of valves that control the production of production fluids (112) that come from a production zone located beneath the surface location (110). The valves also allow for access to the subsurface portion of the well (100).

The well (100) has three strings of casing: conductor casing (114), surface casing (116), and production casing (118). The casing strings are made of a plurality of long high-diameter tubulars threaded together. The tubulars may be made out of any durable material known in the art, such as steel. The casing strings are cemented in place within the well (100). The casing strings may be fully or partially cemented in place without departing from the scope of the disclosure herein.

Each string of casing, starting with the conductor casing (114) and ending with the production casing (118), decreases in both outer diameter and inner diameter such that the surface casing (116) is nested within the conductor casing (114) and the production casing (118) is nested within the surface casing (116). Upon completion of the well (100), the inner circumferential surface (120) of the production casing (118) and the space located within the production casing (118), make up the interior of the well (100).

The majority of the length of the conductor casing (114), surface casing (116), and production casing (118) are located underground. However, the surface-extending portion of each casing string is housed in the casing head (108), also known as a wellhead, located at the surface location (110). The surface-extending portion of each casing string may include a casing hanger (not pictured) that is specially machined to be set and hung within the casing head (108). There may be multiple casing heads (108) depending on the number of casing strings without departing from the scope of the disclosure herein.

Production tubing (122) is deployed within the production casing (118). The production tubing (122) may include a plurality of tubulars connected together and may be interspersed with various pieces of equipment such as artificial lift equipment, packers, etc. The space formed between the outer circumferential surface (124) of the production tubing (122) and the inner circumferential surface (120) of the production casing (118) is called the tubing-casing annulus (126).

The majority of the length of the production tubing (122) is located in the interior of the well (100) underground. However, the surface-extending portion of the production tubing (122) is housed in the tubing head (106) which is installed on top of the casing head (108). The surface-extending portion of the production tubing (122) may include a tubing hanger (not pictured) that is specially machined to be set and hung within the tubing head (106). The tree (102) is connected to the top of the tubing head (106) using the tubing bonnet (104). The tubing bonnet (104) is an adapter comprising one or more seals (not pictured).

In accordance with one or more embodiments, the production casing (118) may comprise a portion made of slotted casing or screen such that production fluids may flow into the production casing (118) from the formation. In other embodiments, the production casing (118) may include perforations made through the production casing (118), cement, and wellbore in order to provide a pathway for the production fluids (112) to flow from the production zone into the interior of the well (100).

The production fluids (112) may travel from the interior of the well (100) to the surface location (110) through the production tubing (122). A pipeline (not pictured) may be connected to the tree (102) to transport the production fluids (112) away from the well (100). The well (100) depicted in FIG. 1 is one example of a well (100) but is not meant to be limiting. The scope of this disclosure encompasses any well (100) design that has at least one string of casing in the well (100). Further, the well (100) may have other variations of surface equipment without departing from the scope of this disclosure.

In conventional well (100) designs, once the production tubing (122) is installed and the tubing hanger has been landed in the tubing head (106), there is no way to access the tubing-casing annulus (126) without removing the production tubing (122) from the well (100). Over the life of the well, there may be multiple scenarios in which the tubing-casing annulus (126) must be accessed in order to take various measurements of the production tubing (122) and the production casing (118).

Removing the production tubing (122) from the well (100) is a time consuming and unsafe operation in terms of well control. Therefore, the ability to access the tubing-casing annulus (126) without having to de-complete the well (100) and remove the production tubing (122) is beneficial. As such, embodiments presented herein disclose systems and methods for accessing and performing measurements within the tubing-casing annulus without removing the production tubing (122) from the well (100) using a scanner tool (200).

Figure 2:
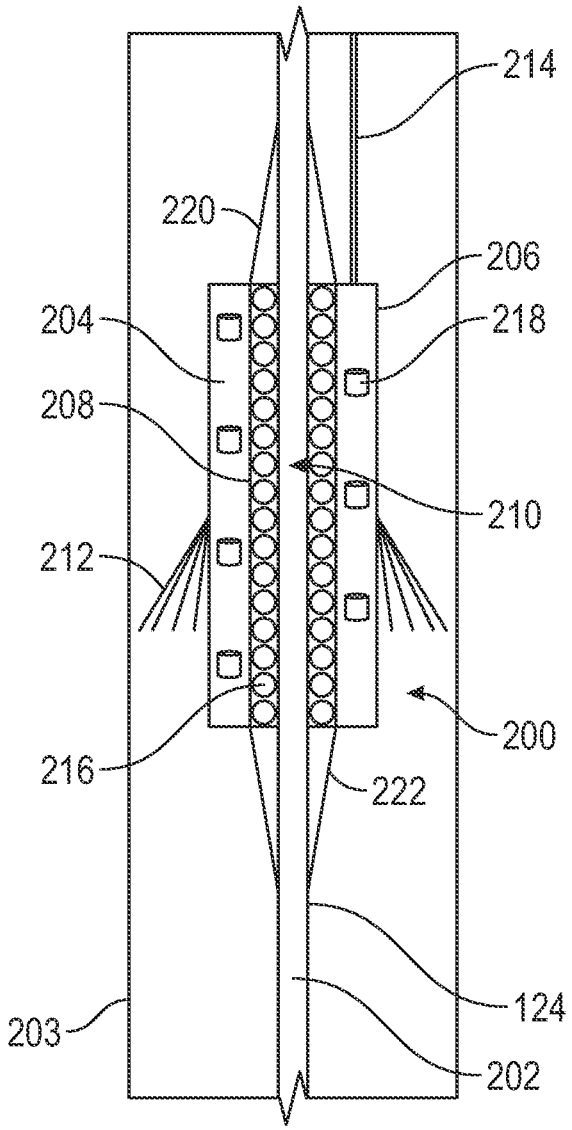
FIG. 2 shows a cross section of a scanner tool installed on a first tubular body disposed within a second tubular body in accordance with one or more embodiments.

FIG. 2 shows a cross section of a scanner tool (200) installed on a first tubular body (202) disposed within a second tubular body (203) in accordance with one or more embodiments. The first tubular body (202) and the second tubular body (203) may be any piece of equipment that is long, round, and hollow, such as the production tubing (122) and the production casing (118) respectively. The first tubular body (202) may vary in size due to various pieces of equipment that are installed along the first tubular body (202). The first tubular body (202) and the second tubular body (203) may be made out of any durable material known in the art, such as steel.

The scanner tool (200) is movably disposed around the outer circumferential surface (124) of the first tubular body (202). The scanner tool (200) is primarily made of a tool housing (204). The tool housing (204) has a housing outer surface (206) and a housing inner surface (208). A conduit (210) runs through the tool housing (204). The conduit (210) is defined by the housing inner surface (208). The first tubular body (202) extends through the conduit (210) of the tool housing (204). The tool housing (204) may be made out of any material known in the art, such as steel.

A plurality of calipers (212) are distributed around the housing outer surface (206). The calipers (212) may be used to measure well data. The well data may include the inner diameter of the second tubular body (203). Each caliper (212), or finger, is independently connected to a sensor (not pictured) located in the tool housing (204). The sensor measurement transforms to a radial measurement of the diameter to detect longitudinal change during movement of the scanner tool (200).

An electronically conductive cable (214) is connected to the tool housing (204). The electronically conductive cable (214) is configured to transmit the well data from the scanner tool (200) to an external receiver. Further, commands in the form of electronic signals may be sent to the scanner tool (200) from an external source using the electronically conductive cable (214). The electronically conductive cable (214) may also be used to move the scanner tool (200) up hole and downhole with respect to the first tubular body (202).

In further embodiments, the tool housing (204) may be flexible. Meaning that the tool housing (204) can axially expand and retract depending on the size of the first tubular body (202). The tool housing (204) may be made flexible being made of a plurality of pieces of material connected together by springs. In other embodiments, the tool housing (204) may be made out of a mesh-like material that is able to expand to fit the largest size of the first tubular body (202) and is able to contract to fit the smallest size of the first tubular body (202).

In accordance with one or more embodiments, the scanner tool (200) comprises a plurality of rollers (216), such as ball bearings, connected to the housing inner surface (208) between the tool housing (204) and the first tubular body (202). The rollers (216) enable the scanner tool (200) to smoothly move over the outer circumferential surface (124) of the first tubular body (202). One or more logging tools (218) may be installed on or within the tool housing (204). The logging tools (218) may be used to measure well data such as temperature, corrosion, etc. The well data gathered by the logging tools (218) may also be transported from the scanner tool (200) using the electronically conductive cable (214).

Slips (220, 222) may be connected to the tool housing (204) and be configured to tighten and loosen around the first tubular body (202). The slips (220, 222) may tighten and loosen upon reception of a signal sent to the scanner tool (200) using the electronically conductive cable (214). When the slips (220, 222) are tightened, they are able to hold the scanner tool (200) in place around the first tubular body (202). When the slips (220, 222) are loosened, they allow the scanner tool (200) to move up hole and downhole along the production tubing (122) using the electronically conductive cable (214). In accordance with one or more embodiments, the slips (220, 222) comprise a set of upper slips (220, 222) (220) and a set of lower slips (220, 222) (222), each connected to opposite ends of the tool housing (204), in order to add more stability to the system. The upper slips (220, 222) (220) and the lower slips (220, 222) (222) are shown in the tightened position in FIG. 2.

Figure 3:
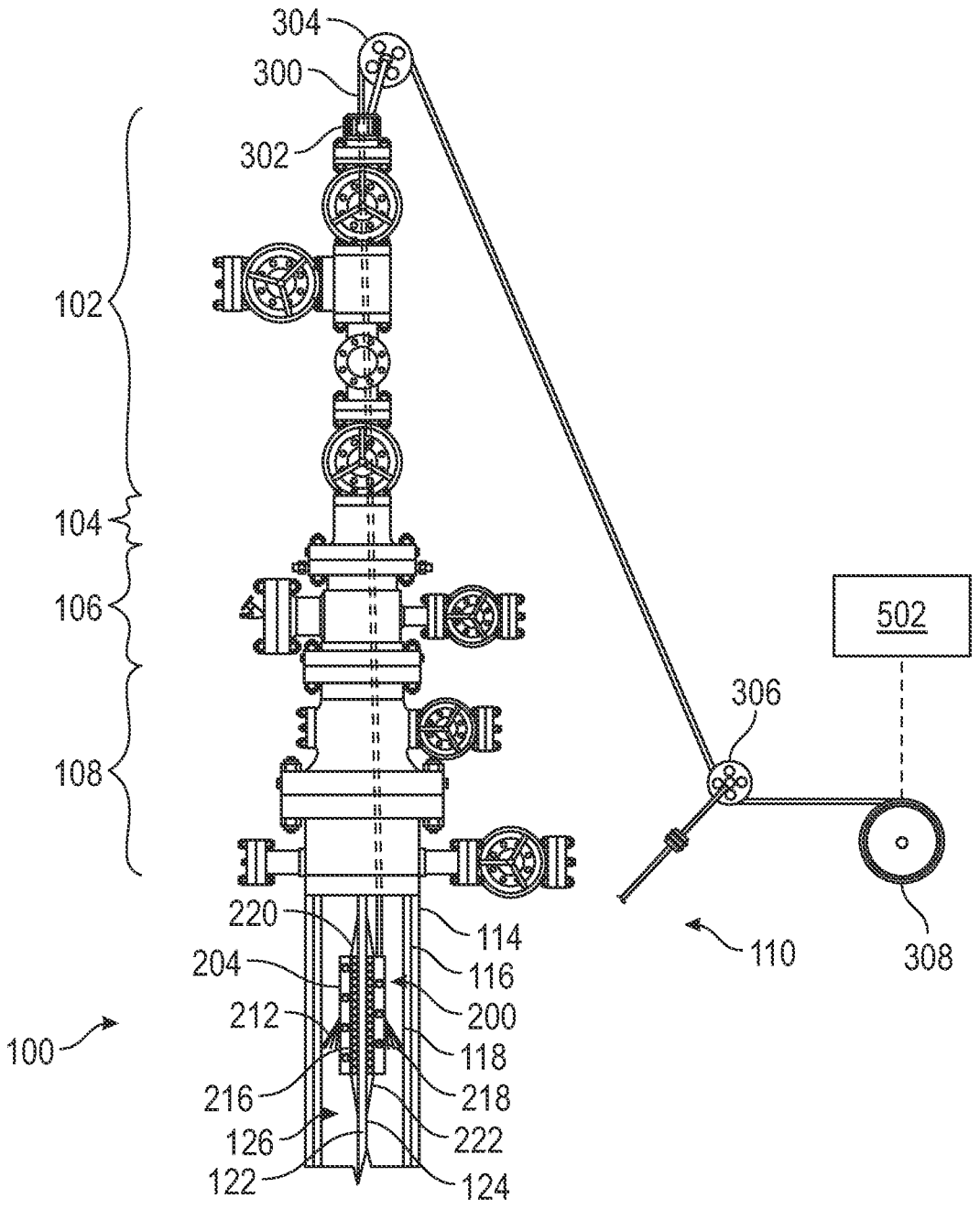
FIG. 3 shows the scanner tool deployed in the well in accordance with one or more embodiments.

FIG. 3 shows the scanner tool (200) deployed in the well (100) in accordance with one or more embodiments. Components shown in FIG. 3 that are the same as or similar to components shown in FIGS. 1 and 2 have not be re-described for purposes of readability and have the same description and function as outlined above. In accordance with one or more embodiments, the first tubular body (202) described in FIG. 2 may be the production tubing (122) as described in FIG. 1. The second tubular body (203) described in FIG. 2 may be the production casing (118) as described in FIG. 1. Further, the electronically conductive cable (214) described in FIG. 2 may be wireline (300).

The scanner tool (200) is movably disposed around the outer circumferential surface (124) of the production tubing (122) and located within the tubing-casing annulus (126). The wireline (300) is connected to the tool housing (204) and runs to the surface location (110) through a modified outlet on the tubing head (106) and tubing bonnet (104). The modified outlet on the tubing head (106) and tubing bonnet (104) is the conventional outlet along with an additional outlet, or hole, for the wireline (300) to extend through. The modified outlet allows the wireline (300) to be run into the inner bore of the tree (102). The wireline (300) exits the tree (102) using a stuffing box (302) having an extended cap and a gate valve. The extended cap is a joint with double flanges to connect the modified outlet tubbing bonnet (104) to a gate valve.

The wireline (300) exiting the stuffing box (302) may be connected to a larger wireline (300) unit including an upper sheave (304), a lower sheave (306), and a wireline (300) reel (308) as shown in FIG. 3. The upper sheave (304) and the lower sheave (306) act as a pulley system to aid in lowering and pulling the wireline (300) into and out of the well (100). In accordance with one or more embodiments, the upper sheave (304) may be anchored to the tree (102) and the lower sheave (306) may be anchored to the ground.

Figure 4:
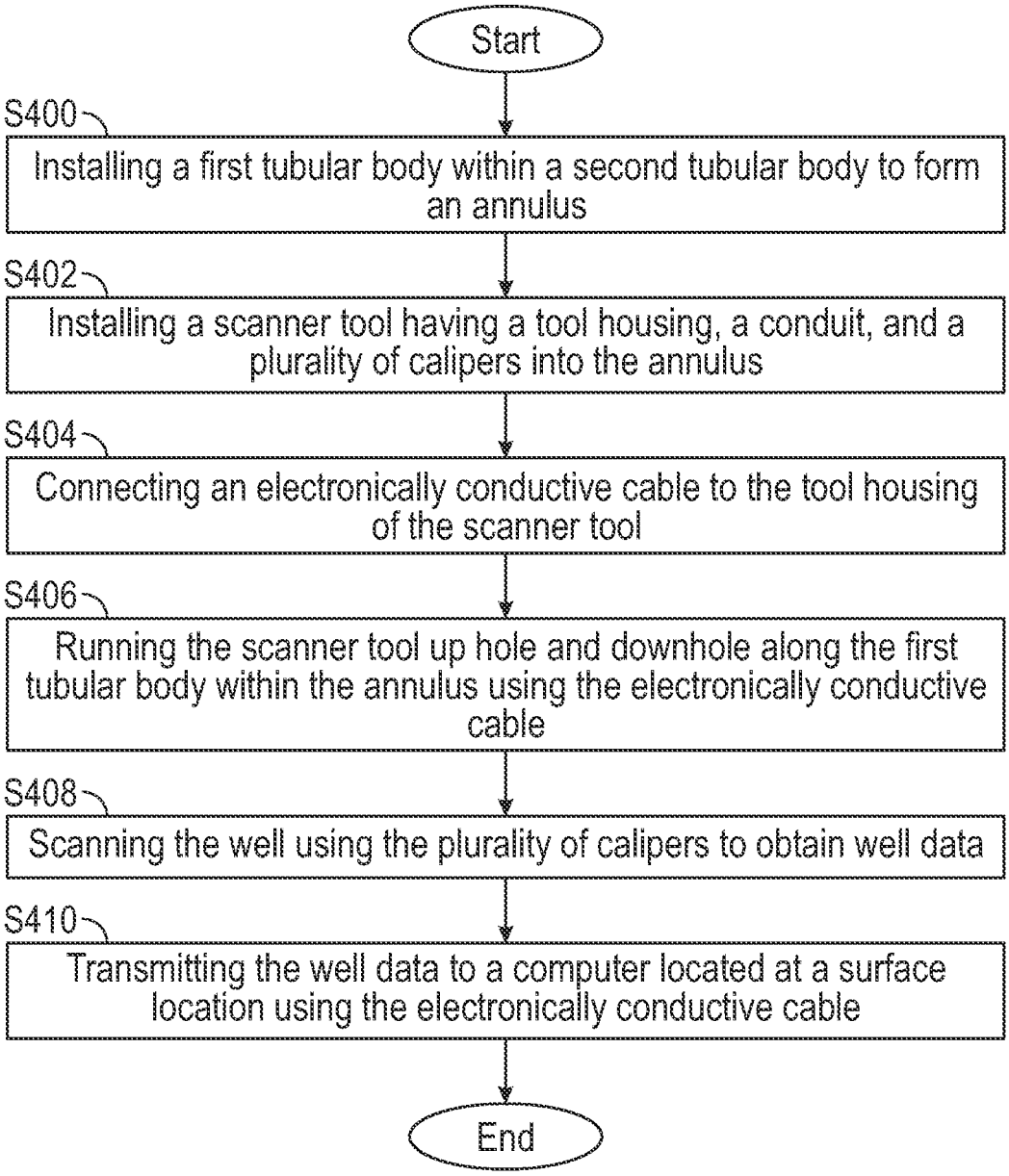
FIG. 4 shows a flowchart in accordance with one or more embodiments.

The wireline (300) may be connected to a computer (502) at the surface location (110). The computer (502) is further described in FIG. 5, below. The signals sent to the scanner tool (200) and the well data sent from the scanner tool (200), using the wireline (300), may be sent/received using the computer (502). Further, the wireline (300) reel (308) may be electronically connected to the computer (502) such that the computer (502) may control the unspooling and spooling of the reel (308) to raise and lower the wireline (300) into the well (100). This raising and lowering of the wireline (300), in turn, moves the scanner tool (200) up hole and downhole along the production tubing (122) within the tubing-casing annulus (126) such that the scanner tool (200) may gather various well FIG. 4 shows a flowchart in accordance with one or more embodiments. The flowchart outlines a method for scanning a well (100) having a second tubular body (203). While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a first tubular body (202) is installed within a second tubular body (203) to form an annulus (126) (S400). In accordance with one or more embodiments, the first tubular body (202) may be production tubing (122), as described in FIG. 1, and the second tubular body (203) may be production casing (118), as described in FIG. 1. Further, the second tubular body (203) may be capped at a surface location (110) using a casing head (108), and the first tubular body (202) may be capped at the surface location (110) using a tubing head (106) connected to the top of the casing head (108). A scanner tool (200) having a tool housing (204), a conduit (210), and a plurality of calipers (212) is installed into the annulus (126) (S402). Specifically, the scanner tool (200) has a conduit (210) the same size as or larger than the size of the first tubular body (202) such that the first tubular body (202) extends through the conduit (210).

An electronically conductive cable (214) is connected to the tool housing (204) of the scanner tool (200) (S404). The electronically conductive cable (214) runs from the tool housing (204) out of the well (100) through a stuffing box (302), having an extended cap and gate valve, and through an outlet on the tubing head (106) and tubing bonnet (104) that is modified to have an electronically conductive cable (214) run therein. In accordance with one or more embodiments, the electronically conductive cable (214) is a wireline (300) and exits the stuffing box (302) to be connected to a larger wireline (300) unit having a reel (308).

The scanner tool (200) is run up hole and downhole along the first tubular body (202) within the annulus (126) using the electronically conductive cable (214) (S406). The reel (308), connected to a computer (502), may be used to lower and raise the wireline (300) to run the scanner tool (200) up hole and downhole within the annulus (126). In accordance with one or more embodiments, the scanner tool (200) includes a plurality of rollers (216) connected to the housing inner surface (208) that allow the scanner tool (200) to roll along the outer circumferential surface (124) of the first tubular body (202).

As the scanner tool (200) runs along the first tubular body (202), the tool housing (204) may expand and retract depending on the size of the section of the first tubular body (202) that the scanner tool (200) is rolling over. In further embodiments, the scanner tool (200) may be held in place on the first tubular body (202) using slips (220, 222) connected to the tool housing (204). Specifically, a signal may be sent along the electronically conductive cable (214) to tighten the slips (220, 222) around the first tubular body (202) to hold the scanner tool (200) in place. Another signal may be sent along the electronically conductive cable (214) to loosen the slips (220, 222) such that the scanner tool (200) may be free to move along the annulus (126).

The well (100) is scanned using the plurality of calipers (212) to obtain well data (S408). The well data obtained by the plurality of calipers (212) may include the inner diameter of the second tubular body (203). Further, the scanner tool (200) may comprise a plurality of logging tools (218) that may be activated by one or more signals sent from the electronically conductive cable (214). The logging tools (218) may gather other forms of well data such as temperature and corrosion. The well data is transmitted to a computer (502) located at a surface location (110) using the electronically conductive cable (214) (S410).

Figure 5:
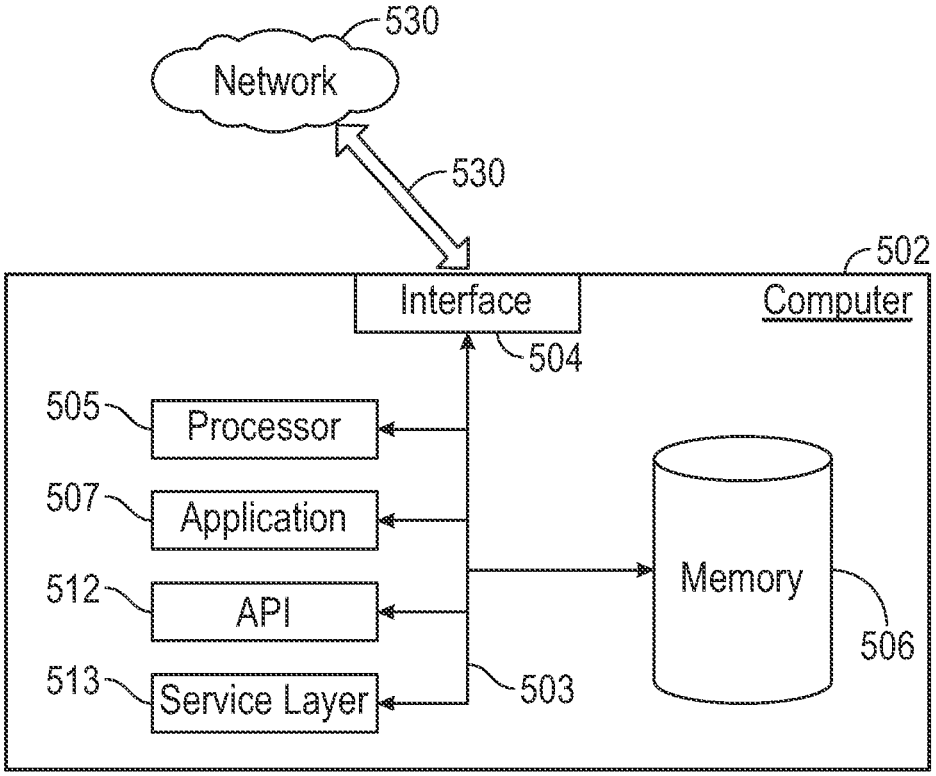
FIG. 5 shows a computer system in accordance with one or more embodiments.

FIG. 5 shows a computer (502) system in accordance with one or more embodiments. Specifically, FIG. 5 shows a block diagram of a computer (502) system used to provide computational functionalities associated with described algorithms, methods, functions, processes, flows, and procedures as described in the instant disclosure, according to an implementation. The illustrated computer (502) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device.

Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud-computing-based, local, global, or other environment (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502)) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502).

The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or other suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504) includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (502).

The computer (502) includes at least one computer processor (505). Although illustrated as a single computer processor (505) in FIG. 5, two or more processors may be used according to particular needs, desires, or particular implementations of the computer (502). Generally, the computer processor (505) executes instructions and manipulates data to perform the operations of the computer (502) and any algorithms, methods, functions, processes, flows, and procedures as described in the instant disclosure.

The computer (502) also includes a non-transitory computer (502) readable medium, or a memory (506), that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), each computer (502) communicating over network (530). Further, the term "client," "user," and other appropriate terminology may be used interchangeably as appropriate without departing from the scope of this disclosure. Moreover, this disclosure contemplates that many users may use one computer (502), or that one user may use multiple computers (502).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A system comprising:

a first tubular body deployed within a second tubular body, the first tubular body forming an annulus between an outer circumferential surface of the first tubular body and an inner circumferential surface of the second tubular body;

a scanner tool movably disposed around the outer circumferential surface of the first tubular body and located within the annulus, the scanner tool comprising:

a tool housing having a housing outer surface and a housing inner surface;

slips connected to the tool housing and configured to tighten or loosen around the first tubular body;

a conduit defined by the housing inner surface, the first tubular body extending therein; and a plurality of calipers distributed around the housing outer surface, wherein the plurality of calipers are configured to measure well data; and an electronically conductive cable connected to the tool housing, wherein the electronically conductive cable is configured to transmit the well data between the scanner tool and a computer located at a surface location, the electronically conductive cable is configured to move the scanner tool up hole and downhole along the first tubular body, and the slips are configured to tighten or loosen around the first tubular body upon reception of a signal from the electronically conductive cable.

2. The system of claim 1, wherein the scanner tool further comprises a plurality of rollers connected to the housing inner surface between the tool housing and the first tubular body.

3. The system of claim 1, wherein the tool housing is flexible and is configured to expand and retract according to a size of the first tubular body.

4. The system of claim 1, wherein the scanner tool further comprises a plurality of logging tools, configured to measure the well data, located within the tool housing.

5. The system of claim 1, wherein the slips further comprises upper slips and lower slips each connected to opposite ends of the tool housing.

6. The system of claim 1, further comprising a casing head capping the second tubular body at the surface location.

7. The system of claim 6, further comprising a tubing hanger located within a tubing head connected to the casing head, wherein the tubing hanger is connected to the first tubular body and comprises an outlet modified to allow the electronically conductive cable to run therein.

8. The system of claim 7, further comprising a tubing bonnet located between the tubing head and a tree, wherein the tubing bonnet comprises the outlet modified to allow the electronically conductive cable to run therein.

9. The system of claim 8, further comprising a stuffing box having an extended cap and gate valve configured to connect the electronically conductive cable to a wireline reel.

10. A method for scanning a well having a second tubular body, the method comprising:

installing a first tubular body within the second tubular body to form an annulus between an outer circumferential surface of the first tubular body and an inner circumferential surface of the second tubular body;

installing a scanner tool into the annulus, wherein the scanner tool is movably located around the first tubular body such that the first tubular body extends through the scanner tool and the scanner tool comprises:

a tool housing having a housing outer surface and a housing inner surface;

slips connected to the tool housing;

a conduit defined by the housing inner surface, the first tubular body extending therein; and a plurality of calipers distributed around the housing outer surface, wherein the plurality of calipers are configured to measure well data;

connecting an electronically conductive cable to the tool housing of the scanner tool;

running the scanner tool up hole and downhole along the first tubular body within the annulus using the electronically conductive cable;

loosening or tightening the slips around the first tubular body upon reception of a signal from the electronically conductive cable;

scanning the well using the plurality of calipers to obtain well data; and transmitting the well data to a computer located at a surface location using the electronically conductive cable.

11. The method of claim 10, wherein running the scanner tool up hole and downhole along the first tubular body further comprises rolling the scanner tool along the outer circumferential surface of the first tubular body using a plurality of rollers connected to the housing inner surface.

12. The method of claim 10, wherein running the scanner tool up hole and downhole along the first tubular body further comprises expanding and retracting the tool housing according to a size of the first tubular body.

13. The method of claim 10, wherein scanning the well further comprises activating a plurality of logging tools, using the electronically conductive cable, located within the tool housing.

14. The method of claim 10, wherein installing the first tubular body within the second tubular body further comprises capping the second tubular body at the surface location using a casing head.

15. The method of claim 14, wherein installing the first tubular body within the second tubular body further comprises installing a tubing hanger into a tubing head connected to the casing head, wherein the tubing hanger is connected to the first tubular body and comprises an outlet modified to allow the electronically conductive cable to run therein.

16. The method of claim 15, wherein installing the first tubular body within the second tubular body further comprises installing a tubing bonnet between the tubing head and a tree, wherein the tubing bonnet comprises the outlet modified to allow the electronically conductive cable to run therein.

17. The method of claim 16, wherein installing the first tubular body within the second tubular body further comprises installing a stuffing box having an extended cap and gate valve configured to connect the electronically conductive cable to a wireline reel.

* * * * *